United States Patent [19]

Phillips et al.

[11] 4,136,725

[45] Jan. 30, 1979

[54] MOTION COMPENSATING LIQUID HOLDING TANK

[75] Inventors: Lawrence M. Phillips, Olivenhain; Homer O. Porter, Del Mar, both of Calif.

[73] Assignee: The United States of America as represented by the Secretary of the Navy, Washington, D.C.

[21] Appl. No.: 753,140

[22] Filed: Jan. 27, 1977

[51] Int. Cl.[2] ..... B63C 9/16

[52] U.S. Cl. ..... 150/0.5; 4/177 CW

[58] Field of Search ..... 150/0.5, 1; 4/177, 172, 4/177 CW

[56] References Cited

U.S. PATENT DOCUMENTS

| | | | |
|---|---|---|---|
| 573,625 | 12/1896 | Ruffner | 150/0.5 |
| 2,443,440 | 6/1948 | Alvarez | 150/0.5 |
| 2,505,845 | 5/1950 | Alvarez | 150/0.5 |
| 2,529,872 | 11/1950 | Hasselquist | 150/0.5 |
| 2,580,879 | 1/1952 | Belokin | 150/0.5 |
| 2,714,726 | 8/1955 | Hasselquist | 4/177 CW |
| 2,719,982 | 10/1955 | Hasselquist | 4/177 CW |
| 2,854,049 | 9/1958 | Wyllie | 150/0.5 |
| 3,001,207 | 9/1961 | Nail | 150/1 |
| 3,158,188 | 11/1964 | Esty | 150/1 |
| 3,428,978 | 2/1969 | Johnson | 150/0.5 |

FOREIGN PATENT DOCUMENTS

| | | | |
|---|---|---|---|
| 1190544 | 10/1959 | France | 150/0.5 |
| 1375044 | 9/1964 | France | 150/0.5 |
| 1013970 | 12/1965 | United Kingdom | 150/0.5 |

*Primary Examiner*—Ro E. Hart

*Attorney, Agent, or Firm*—Richard S. Sciascia; Ervin F. Johnston

[57] ABSTRACT

A motion compensating tank which includes a bottom tank portion which is capable of holding liquid and a top portion which has a flotation collar and a flexible collar. The flotation collar is buoyant in the liquid so as to float substantially level thereon, and the flexible collar sealably joins the flotation collar to the bottom tank portion. With this arrangement liquid which sloshes in the tank can be retained without any substantial spilling over the top of the tank.

8 Claims, 5 Drawing Figures

MOTION COMPENSATING LIQUID HOLDING TANK

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to a liquid holding tank which will prevent spillage when a liquid is sloshed around therein.

The U.S. Navy has demonstrated that marine mammals, such as porpoises and seals, are highly successful in performing salvaging operations. These operations are accomplished by fitting the mammal with a grabber device which normally protrudes in front of his nose. Upon command the mammal will dive to the bottom of the ocean, attach the grabber device to an object to be retrieved, and return to the surface. The grabber device, which is normally tethered to a surface ship, can then be utilized to retrieve the object.

In many of these salvaging operations the mammals are transported on a surface ship to a remote location where the object is located. Sometimes the travel time amounts to many days at sea, during which time the mammals must be cared for with much concern. In the past the porpoise has been kept on a stretcher out of water on the ship with water being sprayed onto the animal periodically. This approach has two major limitations, namely: (1) the mammal can stay out of the water only a few days, and (2) the mammal has no freedom of movement which actually causes a stiffening of his body.

The ideal arrangement would be for the animal to be located in a holding tank aboard the ship. Since ships are not normally equipped with such holding tanks the only other alternative is to provide a portable tank which can be carried on and off the ship as required. In the past, such a tank has appeared impractical because of its size and weight, and the sloshing out of the water from the tank will occur when the ship is in heavy sea states. The present invention makes the portable tank concept feasible and highly desirable. This has been accomplished by providing a lightweight tank which can be easily packaged, and utilized aboard ship to contain the mammal without any substantial sloshing of the water over the top rim of the tank.

SUMMARY OF THE INVENTION

The present invention is a motion compensating tank which includes a bottom tank portion which is capable of holding liquid, and a top portion which has a flotation collar and a flexible collar. The flotation collar is buoyant in the liquid so as to float substantially level therein, and the flexible collar sealably joins the flotation collar to the bottom tank portion. With this arrangement, when there is sloshing liquid in the tank, the liquid will be retained without any substantial spilling over the top of the tank.

STATEMENT OF THE OBJECT OF THE INVENTION

An object of the present invention is to provide a motion compensating liquid holding tank which will retain liquid as it sloshes without any substantial spilling over the top of the tank.

Another object is to provide a liquid holding tank which is lightweight and portable, and which can be utilized aboard a ship to efficiently contain a marine mammal or aquatic species without any substantial spilling when the ship gets into a high sea state.

A further object is to provide an open top liquid holding tank which will continually retain the liquid at its brim even though the liquid is sloshing within the tank.

These and other objects of the invention will become more readily apparent from the ensuing description when taken together with the drawing.

DESCRIPTION OF THE PREFERRED EMBODIMENT

Figure 1:
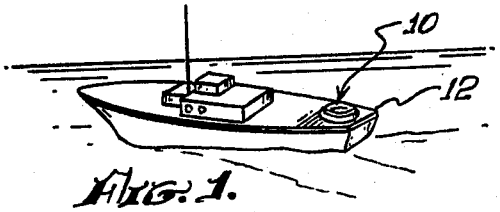
FIG. 1 is an isometric view of the liquid holding tank located on the fantail of a ship.
Figure 2:
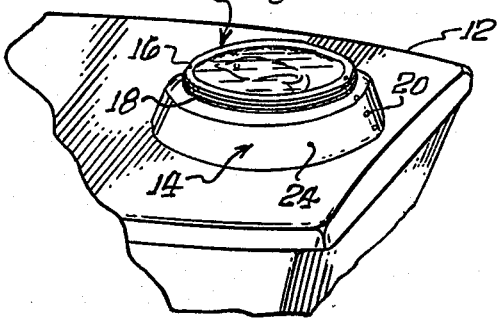
FIG. 2 is an enlarged view of the fantail of the ship with the liquid holding tank.

Referring now to the drawing, wherein like reference numerals designate like or similar parts throughout the several views, there is illustrated in FIG. 1 a motion compensating liquid holding tank 10 which is located on the fantail 12 of a surface ship. The holding tank 10 may be utilized for containing marine mammals or other aquatic species while the ship is underway.

Figure 3:
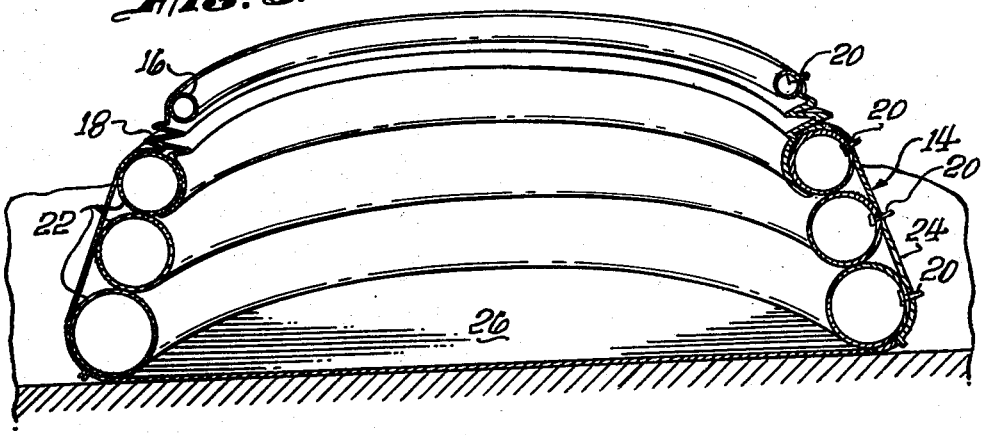
FIG. 3 is a top isometric cross-sectional view of the liquid holding tank.

As illustrated in FIG. 3, the liquid holding tank may include a bottom tank portion 14 which is capable of holding a liquid, and a top tank portion which includes a flotation collar 16 and a flexible collar 18. The flotation collar 16 may be inflatable, and may be provided with an air valve 20. The flotation collar 16 is buoyant in any liquid within the tank so as to float substantially level regardless of the tilting of the tank. The flexible collar 18 is utilized to sealably join the flotation collar 16 to the bottom tank portion 14. In this manner, any sloshing liquid in the tank will be retained without any substantial spilling over the rim of the tank.

In the preferred embodiment of the invention the flexible collar 18 is an accordian flap so that it can be easily extended as the flotation collar 16 is buoyed by the liquid to its generally level condition.

The flexible collar 18 may be constructed of any suitable flexible material such as rubberized fabric.

Figure 4:
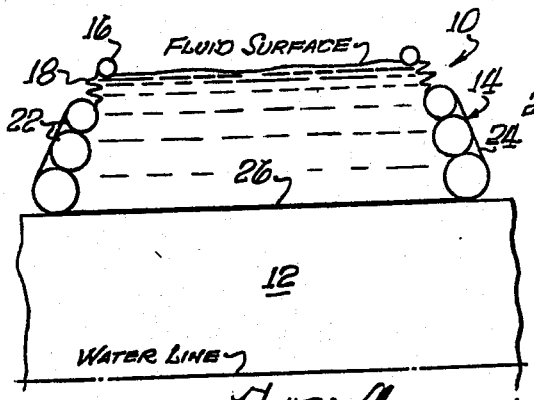
FIG. 4 is a cross-sectional view of the liquid holding tank in a level condition.
Figure 5:
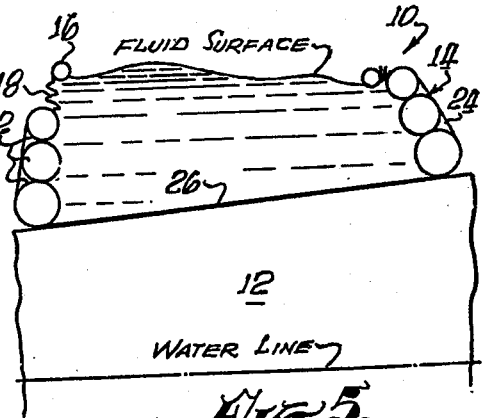
FIG. 5 is a cross-sectional view of the liquid holding tank in a tilted position.

The operation of the tank 10 is significantly increased by constructing the bottom portion 14 of the tank with a plurality of inflatable collars 22. Means are provided for sealably joining the inflatable collars 22 one above the other. This joining means may include a flexible fapered sleeve 24 which is joined to the outside perimeters of the inflatable collars 22. The tapered sleeve 24 may also be constructed of a rubberized fabric material. It is desirable that the inflatable collars be of different sizes and that they be joined in a size progression with the largest on the bottom and the smallest on the top. The bottom inflatable collar may be sealably joined to a bottom 26 of the tank which may also be constructed of rubberized fabric material. The best operation is achieved by joining the inflatable collars 22 in a consecutive, stacked engaging relationship, as illustrated in FIGS. 3, 4, and 5. Each of the inflatable collars 22 may be provided with an air valve 20 for inflating and deflating purposes. The just described bottom portion 14 of the tank is especially useful in absorbing shock loads of the water when it shifts in the tank, thereby contributing to a more stable water condition.

In the preferred embodiment the flotation collar 16 and the inflatable collars 22 are substantially circular, as illustrated in the drawing. It can readily be visualized that when the flotation collar 16 and the inflatable collars 22 are deflated they will press substantially flat against the tank bottom 26 after which the tank can be easily transported on and off the ship.

Obviously, many modifications and variations of the present invention are possible in the light of the above teachings and it is therefore understood that within the scope of the disclosed inventive concept, the invention may be practiced otherwise than as specifically described.

What is claimed is:

1. A motion compensating tank comprising:

a bottom tank portion which is capable of holding a liquid;

a top tank portion which includes a flotation collar and a flexible collar;

the flotation collar being buoyant in the liquid to float substantially level thereon;

the flexible collar being an accordian flap which sealably joins the flotation collar to the bottom tank portion; and the flaps of the flexible collar being substantially parallel to the plane of the flotation collar, whereby sloshing liquid in the tank can be retained by movements of the flotation collar and corresponding expansions and contractions of various sides of the accordian flap.

2. A tank as claimed in claim 1 including:

the accordian flap being constructed of rubberized material.

3. A tank as claimed in claim 1 including:

said bottom portion of the tank including a plurality of inflatable collars; and means sealably joining the inflatable collars one above the other, whereby shock loads of the shifting water are absorbed.

4. A tank as claimed in claim 3 including:

the inflatable collars being of different sizes;

the inflatable collars being joined in a size progression with the largest on the bottom and the smallest on the top whereby the bottom portion of the tank has a tapered configuration.

5. A tank as claimed in claim 4 wherein:

the joining means is a flexible tapered sleeve which is joined to the outside perimeters, of the inflatable collars.

6. A tank as claimed in claim 5 including:

the tapered sleeve joining the inflatable collars in a consecutive stacked engaging relationship.

7. A tank as claimed in claim 6 including:

the accordian flap being constructed of rubberized material.

8. A tank as claimed in claim 7 wherein:

the flotation collar and the inflatable collars are substantially circular.

* * * * *